US009123466B2

(12) United States Patent
Zheng et al.

(10) Patent No.: US 9,123,466 B2
(45) Date of Patent: Sep. 1, 2015

(54) WIRELESS POWER TRANSFER SYSTEMS CONTAINING FOIL-TYPE TRANSMITTER AND RECEIVER COILS

(71) Applicant: Eaton Corporation, Cleveland, OH (US)

(72) Inventors: Qingjie Zheng, Shenzhen (CN); Yilei Gu, Shenzhen (CN); Tangshun Wu, Shenzhen (CN); Tiefu Zhao, Fox Point, WI (US); Jun Xu, Shanghai (CN); Birger Pahl, Milwaukee, WI (US); Yahan Hua, Shanghai (CN)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 14/076,930

(22) Filed: Nov. 11, 2013

(65) Prior Publication Data

US 2015/0130583 A1 May 14, 2015

(51) Int. Cl.

| | |
|---|---|
| ***H01F 27/28*** | (2006.01) |
| ***H01F 27/36*** | (2006.01) |
| ***H01F 38/14*** | (2006.01) |

(52) U.S. Cl.

CPC ..... *H01F 27/2823* (2013.01); *H01F 27/2847* (2013.01); *H01F 38/14* (2013.01); *H01F 2027/2838* (2013.01); *H01F 2027/2857* (2013.01)

(58) Field of Classification Search

CPC ..... H01F 27/28; H01F 27/2847
USPC ..... 336/84 R, 223, 232
See application file for complete search history.

(56) References Cited

U.S. PATENT DOCUMENTS 2,568,169 A * 9/1951 Raczynski ..... 336/223
3,484,727 A * 12/1969 Mutschler et al. ..... 336/147

(Continued)

FOREIGN PATENT DOCUMENTS

GB 1134208 2/1966
WO WO 0225677 A2 3/2002

OTHER PUBLICATIONS

Chen, Qingbin et al., "The New Electric Shielding Scheme with Comb-shaped Wire and its Applications in SMPS"; College of Electrical Engineering and Automation; Fuzhou University; Fuzhou, Fujian, 350108, China; Published in: Telecommunications Energy (INTELEC), 2011 IEEE 33rd International Conference; Oct. 9-13, 2011; ISSN: 2158-5210; 7 pages.

(Continued)

*Primary Examiner* — Mangtin Lian
(74) *Attorney, Agent, or Firm* — Myers Bigel Sibley & Sajovec, PA

(57) ABSTRACT

Wireless power transfer systems include at least one foil-type transmitter/receiver coil with a plurality of turns, which is configured to reduce eddy current losses therein when energized to conduct an alternating current that supports inductive power transfer including coil-to-coil power electrical transfer, inductive heating, etc. The plurality of turns includes at least an outermost turn with a first arcuate-shaped corner having a concave inner surface, which faces an immediately adjacent one of the plurality of turns. The immediately adjacent one of the plurality of turns may also have a second arcuate-shaped corner with a concave inner surface facing an innermost one of the plurality of turns. The first arcuate-shaped corner may have a non-uniform radius of curvature and/or an innermost one of the plurality of turns may have an arcuate-shaped corner, which is a mirror image of the first arcuate-shaped corner when the coil is view in transverse cross-section.

17 Claims, 6 Drawing Sheets

(56) References Cited

U.S. PATENT DOCUMENTS

| | | | | |
|---|---|---|---|---|
| 4,471,335 | A * | 9/1984 | Moritz et al. | 336/206 |
| 6,198,375 | B1 * | 3/2001 | Shafer | 336/225 |
| 6,806,612 | B2 * | 10/2004 | Nakamura et al. | 310/208 |
| 7,411,479 | B2 | 8/2008 | Baarman et al. | |
| 7,495,414 | B2 | 2/2009 | Hui | |
| 7,554,430 | B2 | 6/2009 | Mehrotra et al. | |
| 7,639,110 | B2 | 12/2009 | Baarman et al. | |
| 8,138,875 | B2 | 3/2012 | Baarman et al. | |
| 8,380,998 | B2 | 2/2013 | Azancot et al. | |
| 2006/0049907 | A1 * | 3/2006 | Liu | 336/200 |
| 2009/0160262 | A1 | 6/2009 | Schmidt et al. | |
| 2010/0321664 | A1 | 12/2010 | Makarovic et al. | |
| 2013/0002041 | A1 | 1/2013 | Hatanaka et al. | |
| 2013/0193770 | A1 | 8/2013 | Krishna et al. | |
| 2014/0347156 | A1 | 11/2014 | Ono | |

OTHER PUBLICATIONS

Notification of Transmittal of the International Search Report and the Written Opinion of the International Searching Authority, or the Declaration, in corresponding PCT Application No. PCT/US2014/064824 mailed Feb. 19, 2015 (12 pages).

* cited by examiner

| NO. | without ferrite | eddy current loss (60khz) | with ferrite | eddy current loss (60khz) |
|---|---|---|---|---|
| 1) |  | 76.987w |  | 81.388w |
| 2) |  | 75.272w |  | 82.141w |
| 3) |  | 71.789w |  | 75.384w |
| 4) |  | 67.174w |  | 72.197w |
| 5) |  | 56.791w |  | 64.198w |
| 6) |  | 60.196w |  | 66.196w |
| 7) |  | 68.094w |  | 63.009w |

WIRELESS POWER TRANSFER SYSTEMS CONTAINING FOIL-TYPE TRANSMITTER AND RECEIVER COILS

FIELD OF THE INVENTION

The present invention relates to power transfer systems and, more particularly, to wireless power transfer systems and methods of operating same.

BACKGROUND OF THE INVENTION

Wireless power transfer systems have been receiving increased attention in response to expanding popularity and availability of battery-powered handheld electronic devices. Some wireless power transfer systems use near-field electromagnetic coupling (e.g., mutual inductance) to charge electronic devices by transferring power from a transmitter winding ("primary winding") located external to a device to a receiver winding ("secondary winding") within the device. Wireless connections can provide a number of advantages over conventional hardwired connections, including a high degree of electrical isolation between the transmitter and receiver circuits. Nonetheless, relatively reduced levels of power transfer efficiency have often limited inductive power transfer systems to niche applications. One effort to improve power transfer efficiency is disclosed in U.S. Pat. No. 7,411,479 to Baarman et al., entitled "Inductive Coil Assembly."

As will be understood by those skilled in the art, because a resonant tank circuit within the power transfer system may operate at relatively high frequency, the skin effects of winding conductors should be minimized; otherwise, eddy current losses may be unacceptably high and power transfer efficiency may be unacceptably low. Various techniques have been developed to reduce eddy current losses in high frequency applications. These techniques can include using Litz wire, which consists of thin wire strands that are individually insulated and twisted or woven together, and reduced-thickness copper foil. In addition to increasing power transfer efficiency, the configuration and layout of the primary and secondary windings should also be sufficient to comply with the International commission on Non-Ionizing Radiation Protection Guidelines (ICNIRP) in order to limit human exposure to time-varying EMFs.

SUMMARY OF THE INVENTION

Wireless power transfer systems according to embodiments of the invention include at least one foil-type transmitter/receiver coil configured to reduce eddy current losses therein when energized to conduct an alternating current that supports inductive power transfer. According to some of these embodiments of the invention, a wireless power transfer system can include a foil-type transmitter coil having a plurality of turns therein. This plurality of turns includes at least an outermost turn with a first arcuate-shaped corner having a concave inner surface, which faces an immediately adjacent one of the plurality of turns. This immediately adjacent one of the plurality of turns may also have a second arcuate-shaped corner with a concave inner surface facing an innermost one of the plurality of turns. In some embodiments of the invention, a length of the second arcuate-shaped corner is greater than a length of the first arcuate-shaped corner. In other embodiments of the invention, the first arcuate-shaped corner is sharper than the second arcuate-shaped corner. In still further embodiments of the invention, the first arcuate-shaped corner has a non-uniform radius of curvature and/or an innermost one of the plurality of turns has an arcuate-shaped corner, which is a mirror image of the first arcuate-shaped corner when the coil is view in transverse cross-section. A middle one of the plurality of turns may also have a rectangular-shaped cross-section, with flat inner and outer surfaces. Similarly, a next-to-innermost one of the plurality of turns can have an arcuate-shaped corner that is a mirror image of the second arcuate-shaped corner.

According to still further embodiments of the invention, a wireless power transfer system may include a foil-type coil having N turns, where N is an odd integer greater than one. These N turns include an outermost turn having an at least partially concave inner surface and an innermost turn having an at least partially concave outer surface, which may be a mirror image of the at least partially concave inner surface of the outermost turn. According to still further embodiments of the invention, first and second opposing edges (e.g., top and bottom edges) of the outermost turn can have unequal shape when viewed in transverse cross-section. For example, the first edge may be arcuate-shaped and the second edge may be flat. A ferrite shielding cover may also be provided, which extends adjacent the second edge of the outermost turn. A middle one of the plurality of turns may also have flat inner and outer surfaces. In some further embodiments of the invention, N is an odd integer greater than three, and the outermost turn and a next-to-outermost turn have nonequivalent concave shapes when viewed in transverse cross-section. Alternatively, the outermost turn and a next-to-outermost one of the N turns may have equivalent concave shapes when viewed in transverse cross-section.

According to still further embodiments of the invention, a wireless power transfer system can include a foil-type transmitter coil having N turns, where N is an odd integer greater than one, and a foil-type receiver coil, which is inductively coupled to the foil-type transmitter coil. The N turns includes an outermost turn having an at least partially concave inner surface and an innermost turn having an at least partially concave outer surface. These transmitter and receiver coils may have equivalent dimensions.

Wireless power transfer systems according to still further embodiments of the invention can include a foil-type transmitter coil having a plurality of turns, including an outermost turn having an outer surface that is substantially parallel with magnetic flux lines extending immediately adjacent the outer surface when the transmitter coil is energized to conduct an alternating current therein. In some of these embodiments of the invention, a wireless transmitter for inductive power transfer can include a foil-type coil having an innermost turn and an outermost turn. The outermost turn can have an at least partially curved outer surface that is substantially parallel with magnetic flux lines extending immediately adjacent the curved outer surface when the transmitter coil is energized to conduct an alternating current therein.

DETAILED DESCRIPTION OF EMBODIMENTS

Figure 1A:
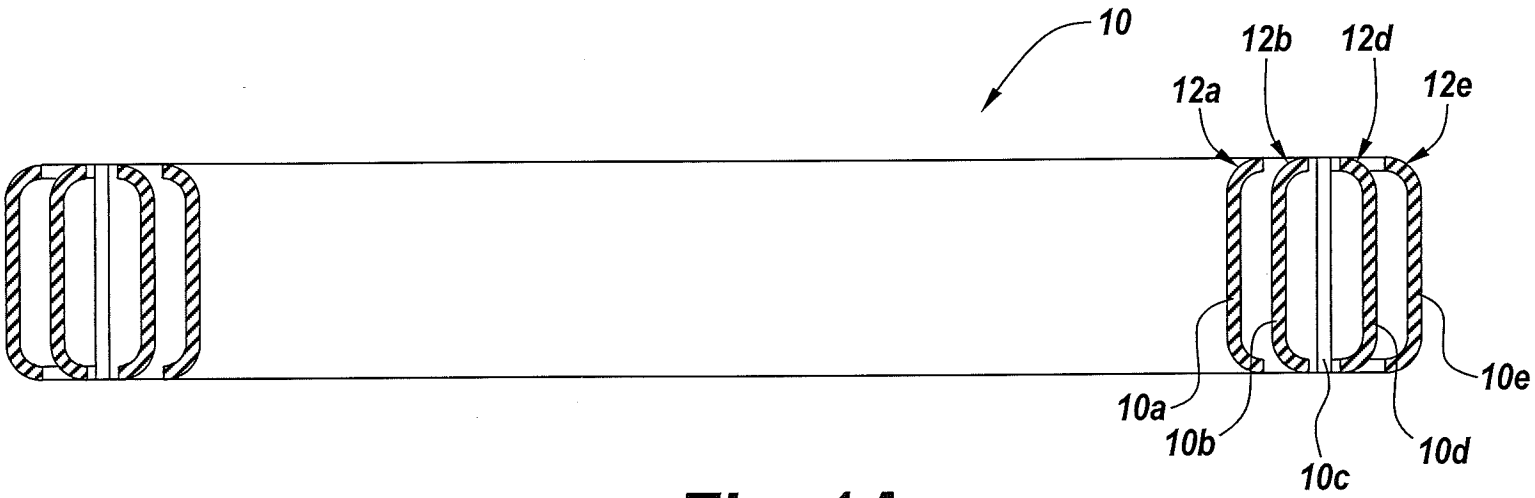
FIG. 1A is a cross-sectional view of a five-turn foil-type transmitter/receiver coil according to an embodiment of the present invention.

The present invention now will be described more fully with reference to the accompanying drawings, in which preferred embodiments of the invention are shown. This invention may, however, be embodied in many different forms and should not be construed as being limited to the embodiments set forth herein; rather, these embodiments are provided so that this disclosure will be thorough and complete, and will fully convey the scope of the invention to those skilled in the art. Like reference numerals refer to like elements throughout.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the present invention. As used herein, the singular forms "a," "an" and "the" are intended to include the plural forms as well, unless the context clearly indicates otherwise. It will be further understood that the terms "comprising", "including", "having" and variants thereof, when used in this specification, specify the presence of stated features, steps, operations, elements, and/or components, but do not preclude the presence or addition of one or more other features, steps, operations, elements, components, and/or groups thereof. In contrast, the term "consisting of" when used in this specification, specifies the stated features, steps, operations, elements, and/or components, and precludes additional features, steps, operations, elements and/or components.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Figure 1B:
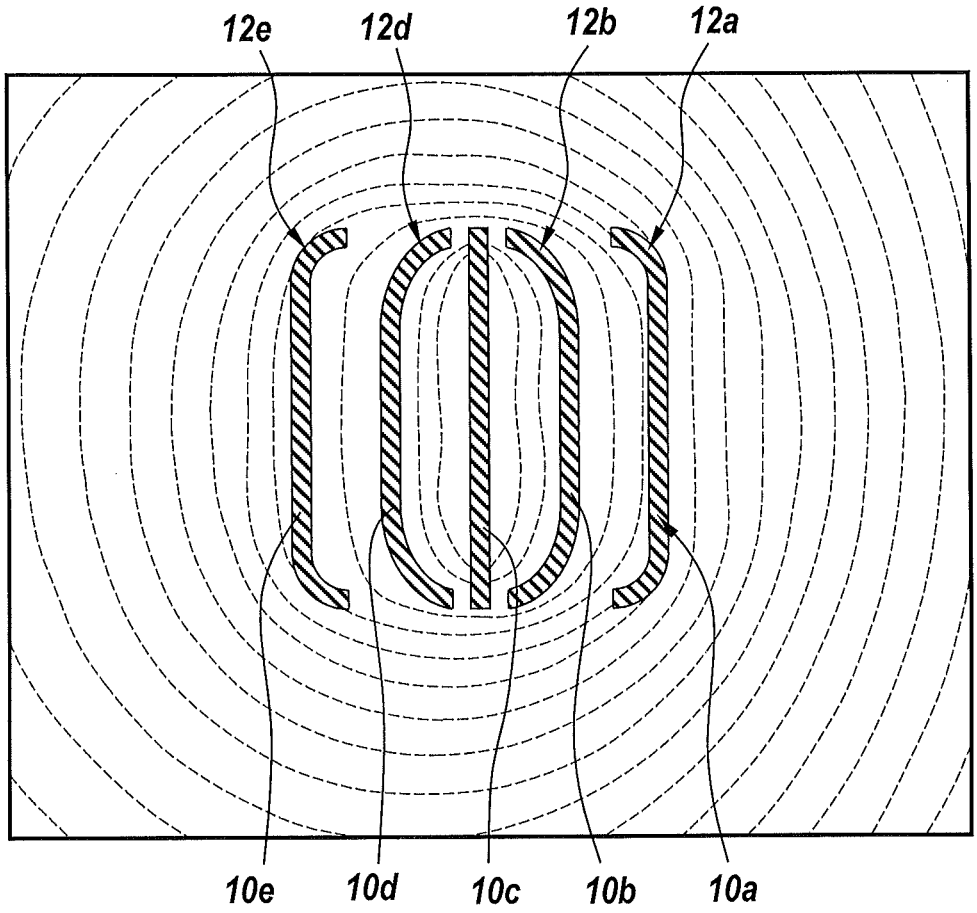
FIG. 1B is a cross-sectional view of a left-side portion of the five-turn foil-type transmitter/receiver coil of FIG. 1A with a plot a magnetic flux lines associated with an excitation current passing through the coil.

Referring now to FIGS. 1A-1B, one example of a foil-type transmitter/receiver coil 10 according to an embodiment of the invention is illustrated as including a plurality of turns 10*a*-10*e*, including at least an outermost turn 10*e* with at least a first arcuate-shaped corner(s) 12*e* having a concave inner surface facing an immediately adjacent one of the plurality of turns 10*d*. This immediately adjacent one of the plurality of turns 10*d* has at least a second arcuate-shaped corner(s) 12*d* with a concave inner surface facing an innermost one of the plurality of turns 10*a*. The plurality of turns may include N turns, where N is an odd integer greater than one. As illustrated by FIG. 1A, a length of the second arcuate-shaped corner 12*d* is greater than a length of the first arcuate-shaped corner 12*e* and concomitantly, the first arcuate-shaped corner 12*e* is sharper than the second arcuate-shaped corner 12*d*. As further illustrated by FIG. 1A, the first arcuate-shaped corner 12*e* may have a non-uniform radius of curvature. In addition, an innermost one of the plurality of turns 10*a* can have an arcuate-shaped corner 12*a* that is a mirror image of the first arcuate-shaped corner 12*e*. FIG. 1A also illustrates that a middle one of the plurality of turns 10*c* has a rectangular-shaped (e.g., flat) cross-section with flat inner and outer surfaces. Furthermore, a next-to-innermost one of the plurality of turns 10*b* can have an arcuate-shaped corner 12*b* that is a mirror image of the second arcuate-shaped corner 12*d*, as illustrated.

Referring now to FIG. 1B, a cross-sectional view of a left-side portion of the five-turn foil-type transmitter/receiver coil of FIG. 1A is provided with a plot of magnetic flux lines associated with a variable excitation current (e.g., AC current) passing through the coil 10. As illustrated, the magnetic flux lines that are immediately adjacent the innermost turn 10*a* and the outermost turn 10*e* are curved in a manner that extends closely parallel to the arcuate-shaped corners 12*a* and 12*e*, which achieves reduced eddy current losses because the flux lines do not operate to "cut" the foil turns as in a conventional foil-type coil having flat innermost and outermost turns.

Figure 2A:
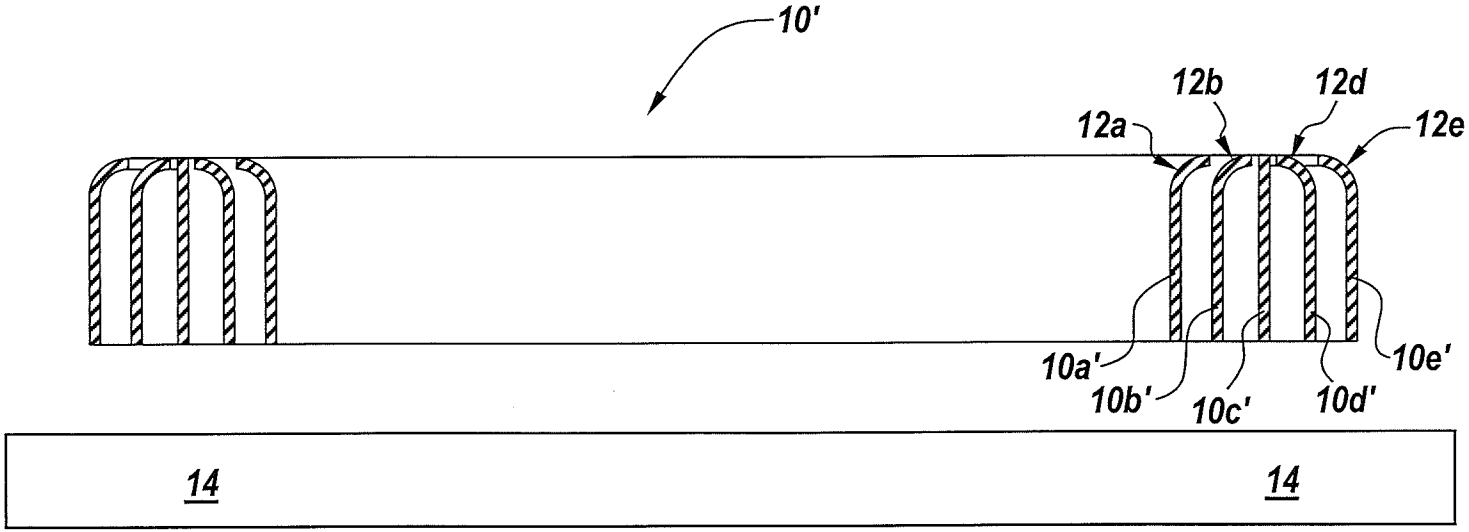
FIG. 2A is a cross-sectional view of a five-turn foil-type transmitter/receiver coil according to an additional embodiment of the present invention, which includes turns having first and second opposing edges of unequal shape.
Figure 2B:
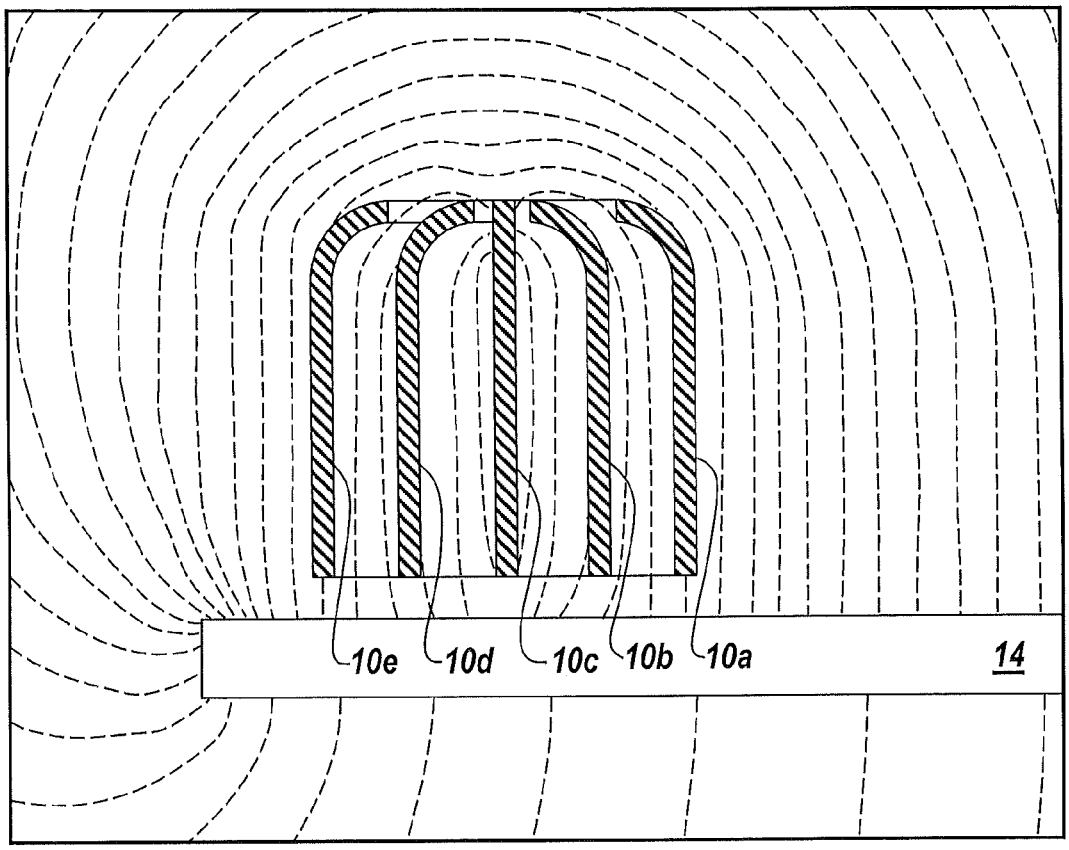
FIG. 2B is a cross-sectional view of a left-side portion of the five-turn foil type transmitter/receiver coil of FIG. 2A adjacent a ferrite shielding cover, with a plot a magnetic flux lines associated with an excitation current passing through the coil and terminating at the cover.

Referring now to FIGS. 2A-2B, another example of a foil-type transmitter/receiver coil 10' according to an embodiment of the invention is illustrated as including a plurality of turns 10*a*'-10*e*', which are similar to the turns 10*a*-10*e* of FIGS. 1A-1B, but include one-sided curved ends and one-sided flat ends that may be positioned closely adjacent a ferrite shielding cover 14 as illustrated by FIG. 2B. This ferrite shielding cover 14 operates to terminate the magnetic flux lines associated with a variable excitation current passing through the coil. The many novel aspects of these coils 10 and 10' of FIGS. 1A-1B and 2A-2B are further highlighted by additional embodiments of the invention in examples (3) through (7) of FIG. 3A (without shielding cover 14) and FIG. 3B (with ferrite ($Fe_3O_4$) shielding cover 14), which show differing degrees and shapes of curvature in the outermost and innermost coils relative to a conventional coil with flat turns (example (1)) and a coil having exclusively convex-shaped turns (example (2)).

Figure 3B:
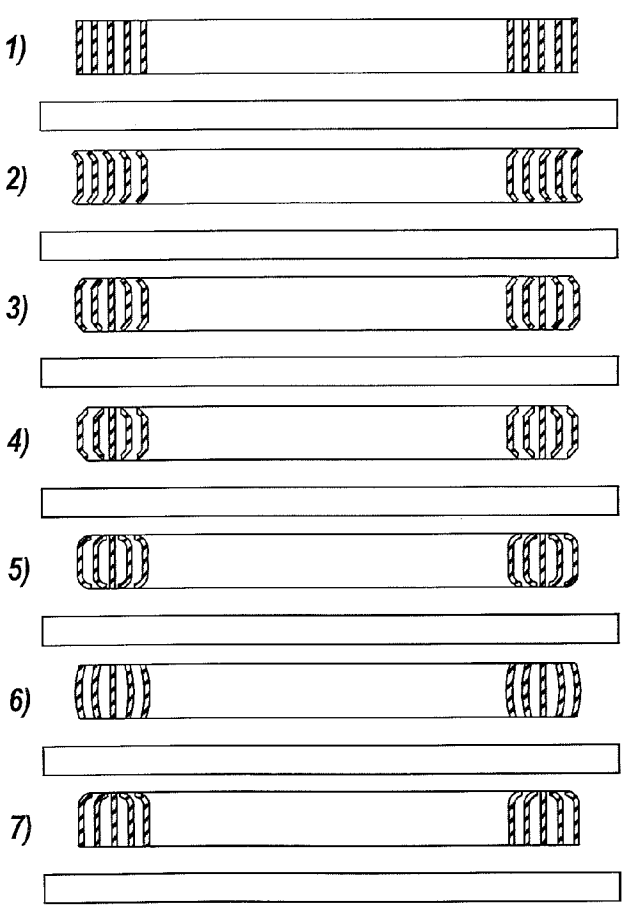
FIG. 3B illustrates cross-sectional views of a plurality of five-turn foil-type transmitter/receiver coils adjacent respective ferrite shielding covers, which highlight a contrast between the prior art and embodiments of the invention.
Figure 3A:
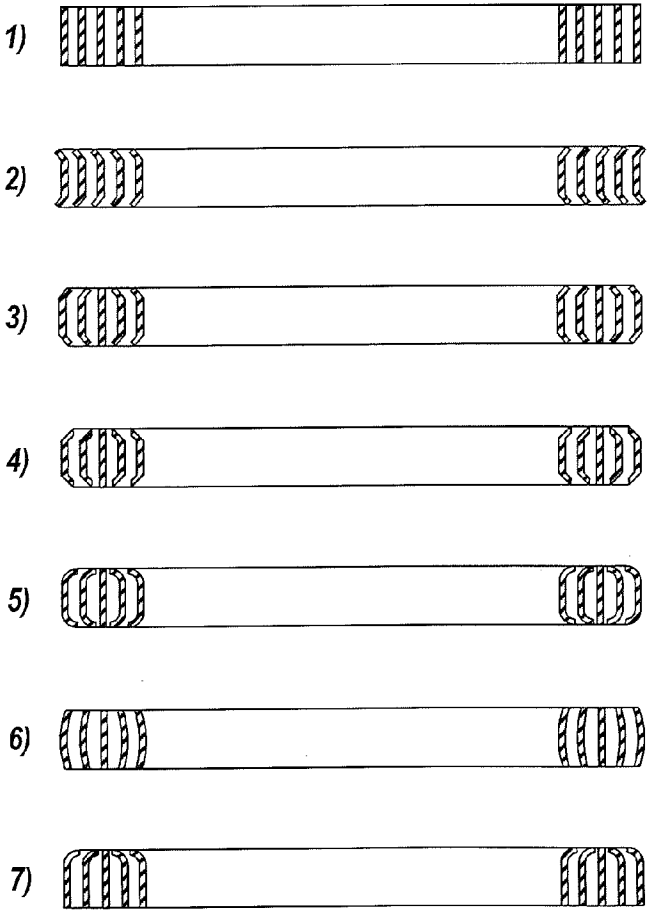
FIG. 3A illustrates cross-sectional views of a plurality of five-turn foil-type transmitter/receiver coils according to embodiments of the present invention, which highlight a contrast between the prior art and embodiments of the invention.
Figure 4:
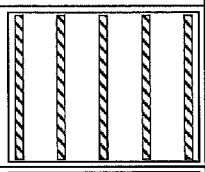
FIG. 4 is a table showing a comparison of eddy current losses among seven types of foil shapes (with and without ferrite shielding covers).
Figure 4:
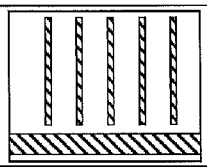
Figure 4:
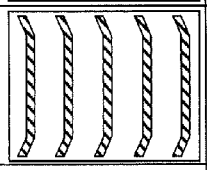
Figure 4:
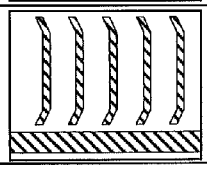
Figure 4:
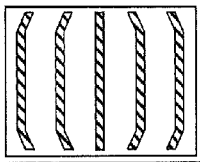
Figure 4:
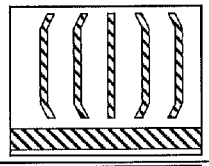
Figure 4:
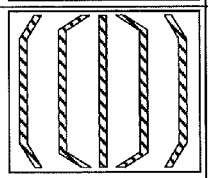
Figure 4:
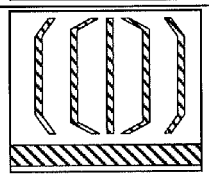
Figure 4:
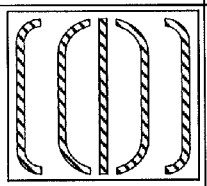
Figure 4:
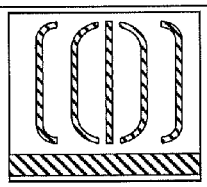
Figure 4:
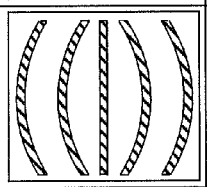
Figure 4:
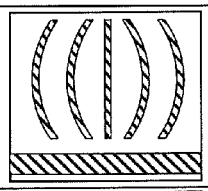
Figure 4:
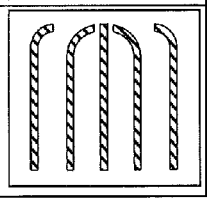
Figure 4:
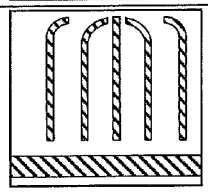

The eddy current losses for the seven (7) examples of FIGS. 3A-3B are illustrated by FIG. 4, for a 5-turn copper coil excited with a 20 ampere current at 60 kHz (sine waveform). The dimensions of the coil include an inner diameter of 21.2 cm, with a spacing of 8 mm between each turn having a cross-section of 1 mm×10 mm. As shown, the coil embodiments of FIGS. 1A-1B and FIG. 4 (example 5, without ferrite shielding cover) offer the lowest eddy current losses of 56.791 Watts, whereas the coil configurations of Examples 1 and 2 demonstrate the worst eddy current losses. Moreover, when a ferrite shielding cover is required for a particular application, such as one requiring a relative high degree of magnetic isolation from a surrounding environment, the coil embodiments of FIGS. 2A-2B and FIG. 4 (example 7) offer the lowest eddy current losses of 63.009 Watts. In the illustrated examples, the ferrite shielding cover may have a diameter of 60 cm with a thickness of 8 mm, may be spaced from the coil by 4 mm and may have a permeability of 1000, for example.

In the drawings and specification, there have been disclosed typical preferred embodiments of the invention and, although specific terms are employed, they are used in a generic and descriptive sense only and not for purposes of limitation, the scope of the invention being set forth in the following claims.

That which is claimed is:

1. A wireless power transfer system, comprising:

a foil-type transmitter coil having a plurality of turns including at least an outermost turn with at least a first arcuate-shaped corner having a concave inner surface facing a convex outer surface of an immediately adjacent one of the plurality of turns, said immediately adjacent one of the plurality of turns having at least a second arcuate-shaped corner with a concave inner surface facing a concave outer surface of an innermost one of the plurality of turns having an arcuate-shaped corner that is a mirror image of the first arcuate-shaped corner; and wherein a middle one of the plurality of turns has flat inner and outer surfaces that face the innermost one of the plurality of turns and the outermost turn, respectively.

2. The system of claim 1, wherein a length of the second arcuate-shaped corner is greater than a length of the first arcuate-shaped corner.

3. The system of claim 1, wherein the first arcuate-shaped corner is sharper than the second arcuate-shaped corner.

4. The system of claim 1, wherein the first arcuate-shaped corner has a non-uniform radius of curvature.

5. The system of claim 1, wherein a next-to-innermost one of the plurality of turns has an arcuate-shaped corner that is a mirror image of the second arcuate-shaped corner.

6. The system of claim 1, wherein the middle one of the plurality of turns has a uniquely-shaped cross-section relative to all other turns in the plurality thereof.

7. The system of claim 1, wherein the plurality of turns are coplanar with each other.

8. The system of claim 1, wherein each of the plurality of turns overlaps at least partially with at least one of a next innermost turn and a next outermost turn.

9. The system of claim 1, wherein all of the plurality of turns within said foil-type transmitter coil are electrically shorted to each other as a continuous piece of foil.

10. A wireless power transfer system, comprising:

a foil-type coil having N turns electrically shorted together, where N is an integer greater than three, said N turns including: an outermost turn having an at least partially concave inner surface facing a center of said foil-type coil, an innermost turn having an at least partially concave outer surface facing the at least partially concave inner surface of the outermost turn, a next-to-outermost turn having an at least partially concave inner surface facing the center of said foil-type coil, and a next-to-innermost turn having an at least partially concave outer surface facing the at least partially concave inner surface of the next-to-outermost turn; wherein the outermost and innermost turns are mirror images of each other when viewed in cross-section and the next-to-outermost and next-to-innermost turns are mirror images of each other when viewed in cross-section; and wherein each of the outermost, next-to-outermost, innermost and next-to-innermost turns has at least one arcuate-shaped corner.

11. The system of claim 10, wherein first and second opposing edges of the outermost turn have unequal shape when viewed in transverse cross-section.

12. The system of claim 11, wherein the first edge is arcuate-shaped and the second edge is flat.

13. The system of claim 12, further comprising a ferrite shielding cover extending adjacent the second edge of the outermost turn.

14. The system of claim 10, wherein a middle one of the plurality of turns has flat inner and outer surfaces.

15. The system of claim 10, wherein the outermost turn and the next-to-outermost turn have nonequivalent shapes when viewed in cross-section.

16. The system of claim 10, wherein the N turns are coplanar with each other.

17. The system of claim 10, wherein each of the N turns overlaps at least partially with at least one of a corresponding next innermost turn and a corresponding next outermost turn.

* * * * *